US006644172B1

(12) United States Patent
Nakayama et al.

(10) Patent No.: US 6,644,172 B1
(45) **Date of Patent: *Nov. 11, 2003**

(54) SLIDING DEVICE

(75) Inventors: Seiichi Nakayama, Toyota (JP); Shogo Muramatsu, Toyota (JP); Akira Takenaka, Toyota (JP)

(73) Assignee: Taiho Kogyo Co., Ltd., Toyota (JP)

( * ) Notice: Subject to any disclaimer, the term of this patent is extended or adjusted under 35 U.S.C. 154(b) by 0 days.

This patent is subject to a terminal disclaimer.

(21) Appl. No.: 09/889,708

(22) PCT Filed: Nov. 24, 2000

(86) PCT No.: PCT/JP00/08268

§ 371 (c)(1),
(2), (4) Date: Jul. 18, 2001

(87) PCT Pub. No.: WO01/38733

PCT Pub. Date: May 31, 2001

(30) Foreign Application Priority Data

Nov. 26, 1999 (JP) ..... 11-335610

(51) Int. Cl.[7] ..... F04B 39/00
(52) U.S. Cl. ..... 92/71; 92/153
(58) Field of Search ..... 92/12.2, 71, 155; 91/499; 417/269

(56) References Cited

U.S. PATENT DOCUMENTS 4,568,252 A * 2/1986 Hattori et al. ..... 92/71
4,641,570 A * 2/1987 Futamura et al. ..... 92/71
4,662,267 A * 5/1987 Kaku et al. ..... 92/71
5,943,941 A * 8/1999 Kato et al. ..... 92/71
6,024,010 A * 2/2000 Kato et al. ..... 92/71
6,435,074 B1 * 8/2002 Tanaka et al. ..... 92/72

FOREIGN PATENT DOCUMENTS

JP 07083165 A * 3/1995 ..... F04B/27/08

* cited by examiner

*Primary Examiner*—Edward K. Look
*Assistant Examiner*—Thomas E. Lazo
(74) *Attorney, Agent, or Firm*—Flynn, Thiel Boutell & Tanis, P.C.

(57) ABSTRACT

A semi-spherical shoe 1 includes a semi-spherical surface 1A and a flat end face 1B. The semi-spherical surface 1A comprises a sliding contact region 1*a* which is disposed in sliding contact with a semi-spherical recess 2B formed in a piston 2, and a lead-in 1*b* which is located above the sliding contact region 1*a* or disposed toward a top (recess 1C) of the semi-spherical shoe. The lead-in 1*b* has a diameter D1 of the sliding contact region 1*a*, thereby allowing a clearance 8 to be produced between lead-in 1*b* and an opposing portion of the semi-spherical recess 2B in the piston 2. A reservoir of lubricant oil in a space 4 formed between the semi-spherical recess 2B and the recess 1C of the semi-spherical shoe 1 is introduced into the sliding contact region 1*a* through the clearance 8. A sliding system having an excellent sliding response over the prior art is provided.

11 Claims, 4 Drawing Sheets

SLIDING DEVICE

FIELD OF THE INVENTION

The invention relates to a sliding system which is provided with a semi-spherical shoe, and more particularly, to a sliding system which is preferred for use as a semi-spherical shoe interposed between a piston and a swash plate of a swash plate compressor, for example.

BACKGROUND OF THE INVENTION

The use of a semi-spherical shoe including a semi-spherical surface and a flat end face in a swash plate compressor is known in the art.

A semi-spherical shoe is known in the art in which a top end thereof is notched in a direction perpendicular to the axis to define a flat surface (see Japanese Laid-Open Patent Application No. 76,281/1982 and Japanese Laid-Open Utility Model Application No. 7, 288/1988). With this semi-spherical shoe, when the semi-spherical surface of the semi-spherical shoe is fitted into a semi-spherical recess formed in a piston, a space is defined between the semi-spherical recess and the flat surface located at the top end of the semi-spherical shoe and can serve as a reservoir for a lubricant oil.

In the conventional semi-spherical shoe, a sliding contact region which is disposed in sliding contact with the semi-spherical recess in the piston is defined by part of the semi-spherical surface located between the flat surface at the top end of the semi-spherical surface and the end face.

However, in the construction of the conventional semi-spherical shoe, part of the semi-spherical surface which is located above the sliding contact region has the same diameter as the remainder of the semi-spherical surface, and accordingly, the arrangement is substantially not adapted to provide a clearance between the semi-spherical surface above the sliding contact region and the semi-spherical recess in the piston. Accordingly, if a reservoir of lubricant oil is maintained in a space formed between the semi-spherical recess and the flat surface at the top end of the semi-spherical shoe, the lubricant in the space is less susceptible to being guided into the sliding contact region disadvantageously, which explains for a poor sliding response of the conventional semi-spherical shoe.

DISCLOSURE OF THE INVENTION

In view of the foregoing, according to the present invention, there is provided a sliding system including a first movable member having a semi-spherical recess, a second movable member having a flat surface, and a semi-spherical shoe having a semi-spherical surface which is fitted into the semi-spherical recess of the first movable member and an end face disposed in sliding contact with the flat surface of the second movable member wherein a sliding contact region which is disposed in sliding contact with the semi-spherical recess is defined between the top and the end face of the semi-spherical surface, with a region of the semi-spherical surface which is located above the sliding contact region being a lead-in so that when the semi-spherical surface is fitted into the semi-spherical recess, a clearance is defined between the lead-in and the opposing portion of the semi-spherical recess which gradually increases toward the top of the semi-spherical surface.

With this arrangement, the clearance defined between the lead-in and the opposing portion of the semi-spherical recess allows a lubricant oil which is stored in the space between the semi-spherical recess and the top portion of the shoe to be introduced into the sliding contact region through the clearance. In this manner, there is provided a sliding system having an excellent sliding response as compared with the prior art.

BEST MODES OF CARRYING OUT THE INVENTION

Figure 1:
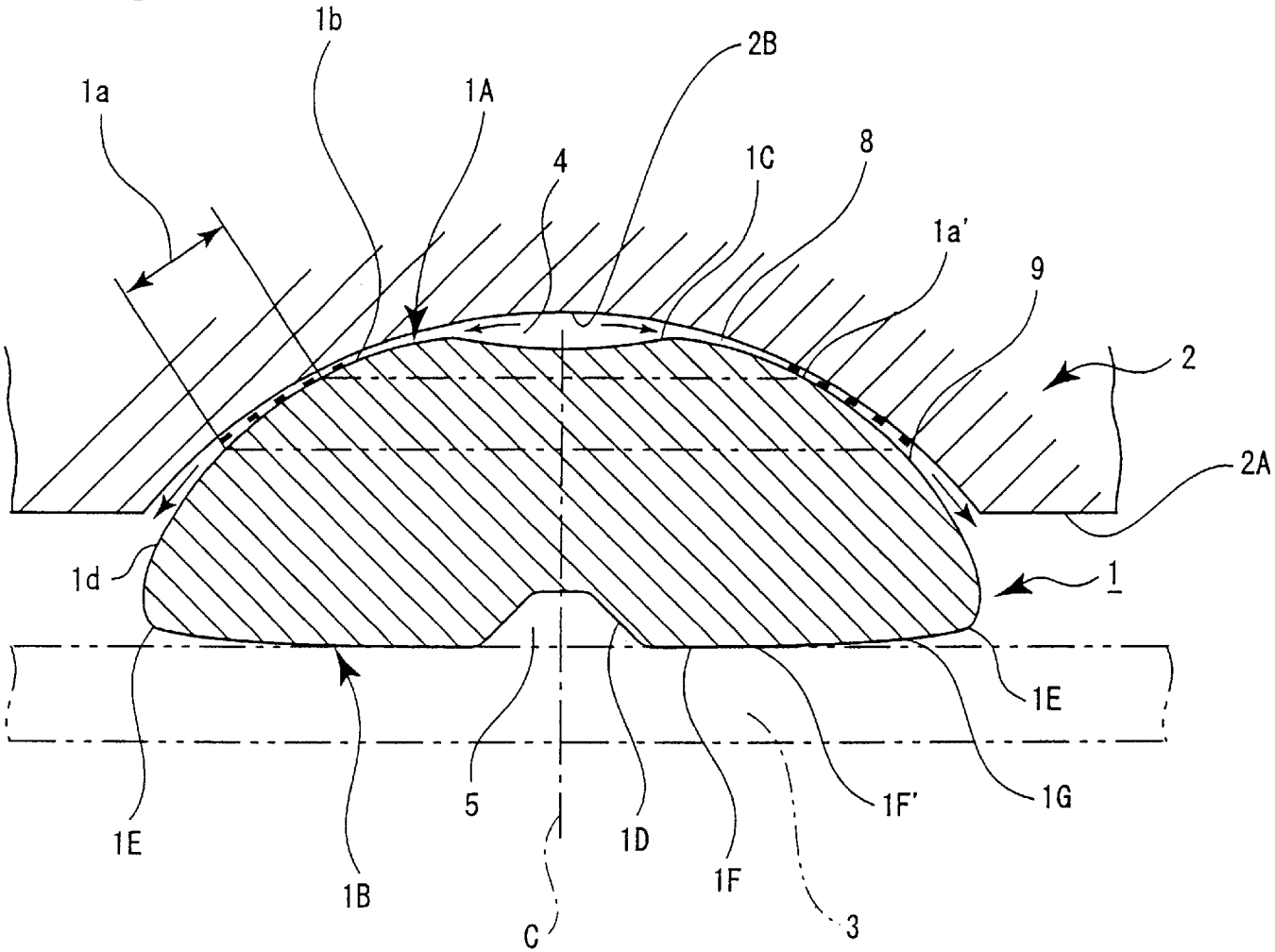
FIG. 1 is a cross section of one embodiment of the invention.
Figure 2:
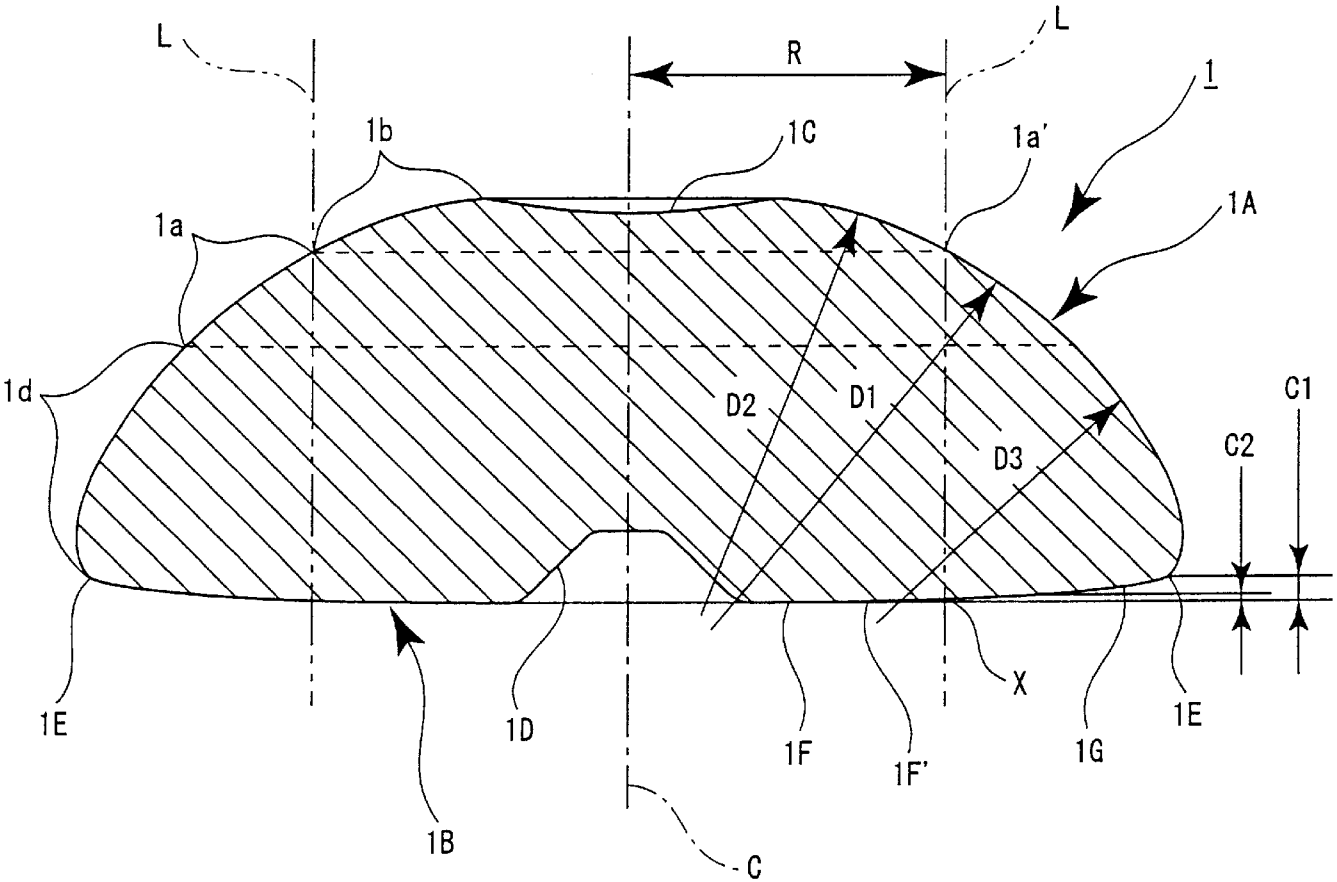
FIG. 2 is a cross section, to an enlarged scale, of the semi-spherical shoe shown in FIG. 1.

Several embodiments of the invention will now be described. FIGS. 1 and 2 show an embodiment illustrating a sliding system according to the invention applied to a swash plate compressor. Specifically, the swash plate compressor comprises a semi-cylindrical shoe 1, a piston 2 which is disposed for reciprocating motion in the vertical direction as viewed in FIG. 1, and a flat swash plate 3 which is driven for rotation by a rotary shaft. The piston 2 has an end face 2A in which a semi-spherical recess 2B is formed. In this embodiment, the semi-spherical recess 2B is formed so that its curvature is uniform over the entire region thereof.

The semi-cylindrical shoe 1 comprises a semi-spherical surface 1A and a flat end face 1B. The top of the semi-spherical surface 1A as viewed in the axial direction, or an upper portion as viewed in FIG. 1, is slightly notched in a direction perpendicular to an axis C, thus defining a shallow recess 1C which is arcuate in section. In a portion toward the axis, the end face 1B is formed with a substantially conical opening 1D. The top recess 1C has a depth which is chosen to be on the order of about one-third the depth of the opening 1D formed in the end face 1B.

The semi-spherical shoe 1 is arranged so that its semi-spherical surface 1A is fitted into the semi-spherical recess 2B in the piston 2 while the end face 1B is disposed in abutment against the swash plate 3. When the semi-spherical shoe 1 is interposed between the semi-spherical recess 2B and the swash plate 3, a region of the semi-spherical surface 1A which is located adjacent to a boundary 1E between the semi-spherical surface 1A and the end face 1B is exposed in a space formed between the end face 2A of the piston 2 and the swash plate 3.

A space 4 is defined by the recess 1C and the semi-spherical recess 2B in the piston 2 while a space 5 is defined by the opening 1D and the swash plate 3. These spaces 4 and 5 serve as temporary reservoir chambers for a lubricant oil.

When the swash plate 3 is driven for rotation, the piston 2 is driven for reciprocating motion through the semi-spherical shoe 1. At this time, the end face 1B of the semi-spherical shoe 1 slides relative to the swash plate 3 while the semi-spherical surface 1A slides relative to the semi-spherical recess 2B. During this process, the lubricant oil which is stored in the spaces 4 and 5 permeates into the regions of sliding contact of the semi-spherical surface 1A and the end face 1B, thus lubricating and cooling these regions.

In the present embodiment, the semi-spherical surface 1A has a sliding contact region 1*a* of a diameter D1 and a lead-in 1*b* located above the sliding contact region 1*a* or disposed toward the top recess 1C, the lead-in 1*b* having a diameter D2 which is different from the diameter D1.

Thus, in the semi-spherical shoe 1 of this embodiment, the entire semi-spherical surface 1A is not in sliding contact with the semi-spherical recess 2B, but an annular region located between the end face 1B and the top recess 1C and disposed close to the recess 1C defines the sliding contact region 1*a* which is disposed in sliding contact with the semi-spherical recess 2B.

Another annular region of the semi-spherical surface 1A which is located nearer the top recess 1C than the sliding contact region l*a* is defined as the lead-in 1*b*. A further annular region of the semi-spherical surface 1A which is disposed nearer the end face 1B than the sliding contact region 1*a* defines a non-sliding contact region 1*d* which is not disposed in sliding contact with semi-spherical recess 2B.

In the present embodiment, the diameter D2 of the lead-in 1*b* of the semi-spherical surface 1A is greater than the diameter D1 of the sliding contact region 1*a* of the semi-spherical surface 1A.

In this manner, a clearance 8 which gradually increases toward the top recess 1C is formed between the lead-in 1*b* and the opposing portion of the semi-spherical recess 2B in the piston 2 (see FIG. 1). Sizes of various parts are adjusted so that the clearance 8 has a maximum size in a range from 5 to 500 $\mu$m.

This allows the lubricant oil which is stored in the space 4 formed between the semi-spherical recess 2B and the recess 1C of the semi-spherical shoe 1 to be smoothly introduced toward and into the sliding contact region 1*a* through the clearance 8.

The non-sliding contact region 1*d* disposed close to the end face 1B has a diameter D3 which is less than the diameter D1 of the sliding contact region 1*a*. As a consequence, a clearance 9 which gradually increases toward the end face 1B is formed between the non-sliding contact region 1*d* and the opposing portion of the semi-spherical recess 2B in the piston 2. Any lubricant oil which is distributed around the sliding contact region 1*a* is easily displaced toward the end face 1B through the clearance 9.

The surface of the sliding contact region 1*a* of the semi-spherical surface 1A may be coated by a resin film containing $MoS_2$, Gr or the like. Alternatively, the surface of the sliding contact region 1*a* of the semi-spherical surface 1A may be subject to a soft nitriding treatment before it is coated by the resin film mentioned above. As a further alternative, the surface of the sliding contact region 1*a* of the semi-spherical surface 1A may be coated by a hard film layer selected from DLC (amorphous carbon film), Ni—P plating and Ni—B plating. When the surface of the sliding contact region 1*a* is coated in this manner, a seizure of the sliding contact region 1*a* can be prevented.

In addition, in the present embodiment, in a region disposed toward the axis or the opening 1D, the end face 1B of the semi-spherical shoe 1 bulges toward the swash plate 3 than in the boundary 1E which defines the outer periphery. The region disposed toward the axis is formed as a flat surface, which defines a sliding contact region 1F to be disposed in sliding contact with the swash plate 3.

A region extending from an outer edge 1F' of the sliding contact region 1F to the boundary 1E is formed to depict a gentle arc in section, and defines a non-sliding contact region 1G which is not disposed in sliding contact with the swash plate 3.

When forming the non-sliding contact region 1G, the outer edge 1F' of the sliding contact region 1F is located nearer the axis C than a distance R (radius) by which an edge 1*a'*, which is located nearer the top recess 1C, of the sliding contact region 1*a* of the semi-spherical surface 1A is spaced from the axis C (see FIG. 2). When an imaginary line L is drawn parallel to the axis C so as to intersect with the edge 1*a'*, a point X where the line L intersects with the non-sliding contact region 1G, the sliding contact region 1F and the boundary 1E are related to each other such that denoting a distance by which the sliding contact region 1F and the boundary 1E are spaced axially (or a bulge of the sliding contact region 1F) by C1 and a distance by which the sliding contact region 1F and the point X are spaced axially by C2, the inequality $C2/C1 \leqq 0.3$ is satisfied.

In this manner, in this embodiment, a region of the end face 1B located toward the axis (or the sliding contact region 1F) bulges beyond the boundary 1E which defines the outer periphery of the end face 1B as a result of the choice of sizes as mentioned above.

Figure 3:
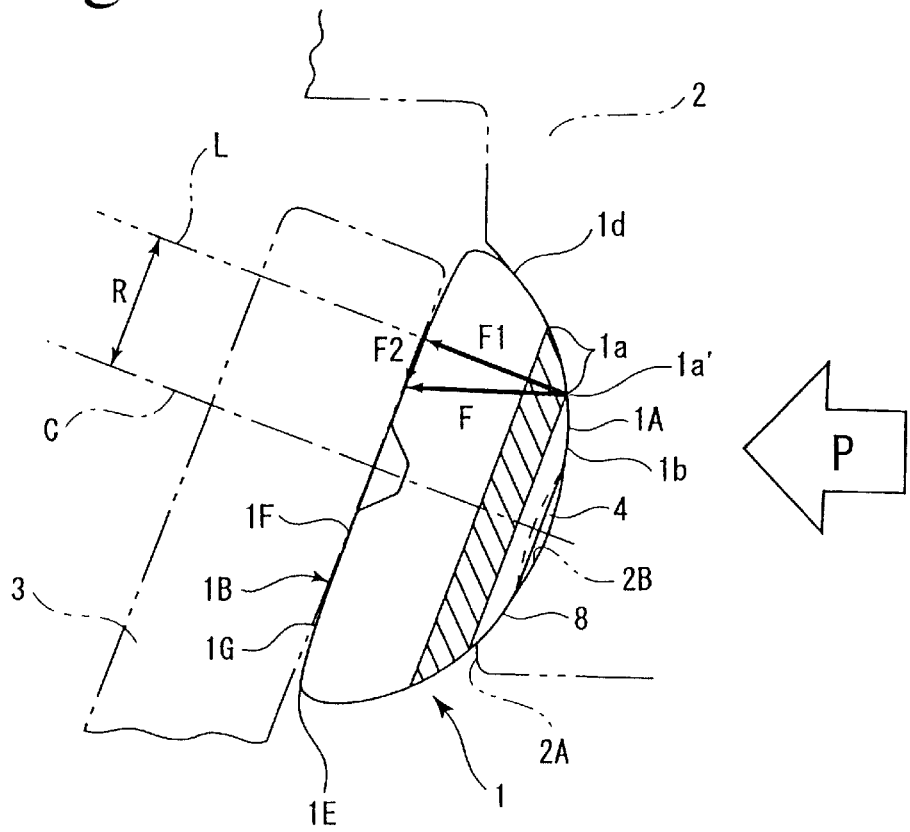
FIG. 3 shows a condition of the semi-spherical shoe during the operation of a swash plate compressor shown in FIG. 1.

Accordingly, during an actual use of the semi-spherical shoe 1, a maximum load P applied to the piston 2 along an axis thereof is supported by the sliding contact region 1F of the end face 1B which is located on the swash plate 3 that assumes its most skewed position. As a consequence, the semi-spherical shoe 1 which is interposed between the semi-spherical recess 2B in the piston 2 and the swash plate 3 assumes a greatly stabilized position during the operation of the swash plate compressor. As will be noted in FIG. 3, the sliding contact region 1*a* of the semi-spherical surface 1A is partly exposed in a space between the end face 2A of the piston 2 and the swash plate 3, whereby the lubricant oil is guided into the region of sliding contact between the sliding contact region 1*a* and the semi-spherical recess 2B.

As mentioned previously, in the semi-spherical shoe 1 of the present embodiment, the diameter D2 of the lead-in 1*b* is greater than the diameter D1 of the sliding contact region 1*a* to define the clearance 8 when the semi-spherical shoe 1 is fitted into the semi-spherical recess 2B in the piston 2. Accordingly, the lubricant oil which is stored in the space 4 between the recess 1C of the semi-spherical shoe 1 and the semi-spherical recess 2B in the piston 2 is smoothly introduced into the sliding contact region 1*a* through the clearance 8, as indicated by arrows in FIG. 1. This improves the sliding response of the semi-spherical shoe 1 as compared with the prior art.

Figure 4:
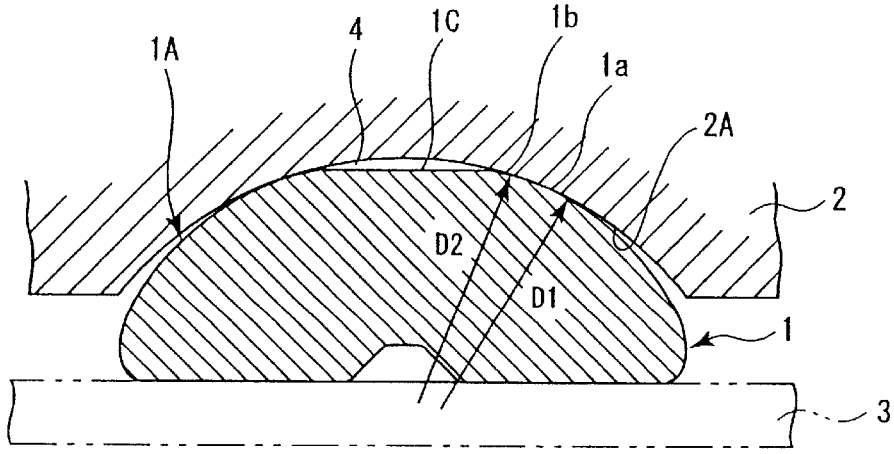
Fig.4 Prior Art
FIG. 4 is a cross section of a conventional semi-spherical shoe.

By contrast, a conventional semi-spherical shoe 1 is shown in FIG. 4. In the conventional semi-spherical shoe 1, the top of the semi-spherical surface 1A is notched to define a flat surface 1C, and a region 1*b* located close to the flat surface 1C of the semi-spherical surface 1A and a sliding contact region 1*a* which is disposed adjacent thereto have diameters D1 and D2, which are equal to each other. Accordingly, this arrangement is less susceptible to producing a clearance between the region 1*b* disposed close to the flat surface 1C of the semi-spherical surface 1A and the semi-spherical recess 2B in the piston 2. This results in a disadvantage that the lubricant oil which is stored in the space 4 between the flat surface 1C and the opposing portion of the semi-spherical recess 2B can hardly be introduced into the sliding contact region 1*a*. This explains for a poor sliding response of the prior art.

In addition, because the top of the conventional semi-spherical shoe 1 is notched to provide the flat surface 1C, the quantity of lubricant oil which can be stored in the space 4 is reduced, which is another disadvantage.

In contrast thereto, in the present embodiment, the recess 1C is formed in the top of the semi-spherical shoe 1, allowing the volume of the space 4 which is formed between the recess 1C and the semi-spherical recess 2B in the piston 2, and hence a quantity of lubricant oil which can be stored therein, to be increased, thus allowing the sliding response of the semi-spherical shoe 1 to be improved.

A choice of various sizes as mentioned above in the present embodiment causes a region of the end face 1B located toward the axis (or the sliding contact region 1F) to bulge beyond the outer periphery (non-sliding contact region 1G). As a consequence of this, the semi-spherical shoe 1 assumes a stabilized position during the operation of the swash plate compressor, permitting a good lubricating and cooling effect upon sliding portions by the lubricant oil.

Second Embodiment

Figure 5:
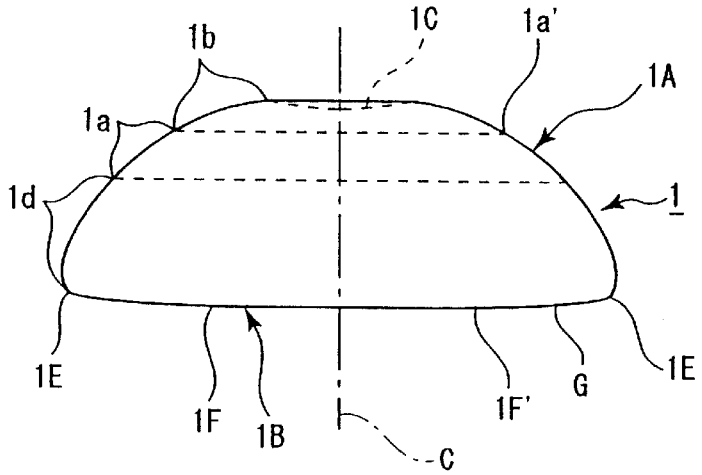
FIG. 5 is a front view of a second embodiment of the invention.

FIG. 5 shows a second embodiment of the semi-spherical shoe 1 where the opening 1D formed in the end face 1B of the semi-spherical shoe 1 shown in the first embodiment is omitted. In other respects, the arrangement is similar to the first embodiment. Again, a similar functioning and effect can be achieved as achieved in the first embodiment.

Third Embodiment

Figure 6:
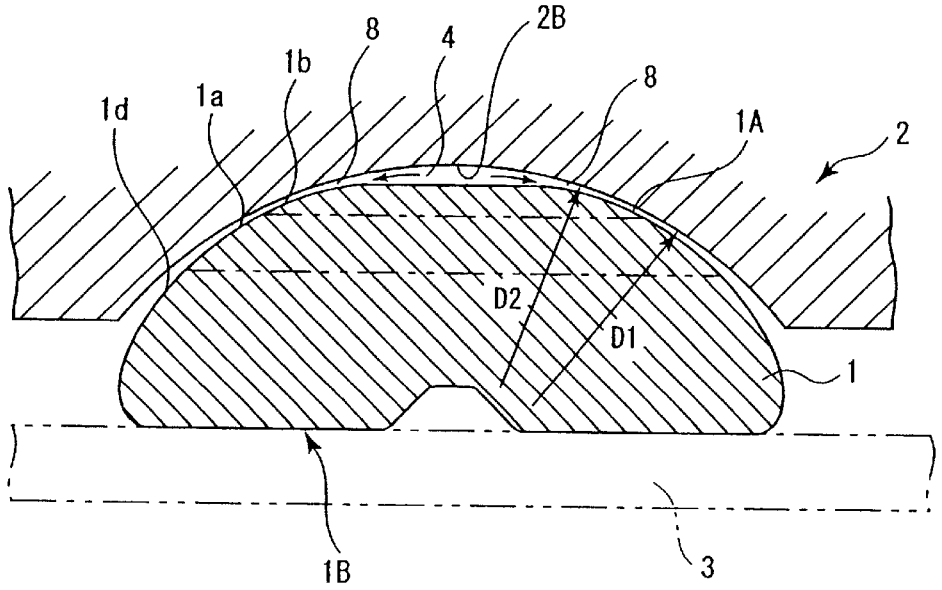
FIG. 6 is a cross section of the third embodiment of the invention.

FIG. 6 shows a third embodiment of the invention. While above embodiments relate to an improvement of the semi-spherical shoe 1, an improvement is applied to the piston 2 in the third embodiment.

Specifically, a sliding contact region la and a lead-in 1*b* disposed close to the top of a semi-spherical surface 1A of a semi-spherical shoe 1 have an equal diameter, in the same manner as in the conventional semi-spherical shoe 1 shown in FIG. 4. However, a portion of the semi-spherical recess 2B formed in the piston 2 which is in sliding contact with the sliding contact region 1*a* has a diameter D1, which is greater than the diameter D2 of a portion of the semi-spherical recess 2B which is located opposite to the lead-in 1*b*.

As a result, a clearance 8 which is similar to the clearance formed in the first embodiment is defined between the semi-spherical recess 2B having the diameter D2 and the lead-in 1*b* of the semi-spherical surface 1A which is oppositely located.

Accordingly, the lubricant oil which is stored in the space 4 is allowed to be introduced into the sliding contact region l*a* through the clearance 8 also in the third embodiment, allowing the sliding response of the semi-spherical shoe 1 and the piston 2 to be improved over the prior art.

Above embodiments have been described above as an application of a sliding system of the invention to a piston, a semi-spherical shoe and a swash plate of a swash plate compressor, but it should be understood that the invention is also applicable to a wobble plate oil pump. In addition, the sliding system of the invention can also be applied to a mechanical component including a semi-spherical recess into which a semi-spherical shoe is fitted.

As described above, an invention provides an advantage that there is provided a sliding system having an improved sliding response over the prior art.

What is claimed is:

1. A sliding system including a first movable member having a flat surface and a semi-spherical recess, a second movable member having a flat surface and a semi-spherical shoe having a semi-spherical surface which is fitted into the semi-spherical recess of the first movable member and an end face which is disposed in sliding contact with the flat surface of the second movable member, wherein an annular sliding contact region is formed on the semi-spherical surface in a region provided between the top of the shoe and the end face, the semi-spherical surface having a lead-in provided in a region located above the annular sliding contact region, the semi-spherical surface being arranged in the semi-spherical recess such that a clearance is formed between the lead-in and an opposing portion of the semi-spherical recess which gradually increases toward the top of the semi-spherical surface, the end face of the shoe comprising a flat annular sliding portion in slidable contact with the flat surface of the second movable member and a concave portion extending from the flat annular sliding portion and away from the second movable member and the outer perimeter of the flat annular sliding portion being located closer to the vertical axis line of the shoe than the inner perimeter of the annular sliding contact region.

2. A sliding system according to claim 1, in which the lead-in has a diameter greater than the diameter of the sliding contact region, thereby forming the clearance.

3. A sliding system according to claim 1, in which the semi-spherical recess has a diameter at a location where it opposes the lead-in, which is less than the diameter of the semi-spherical recess at a location where it is in sliding contact with the sliding contact region, thus allowing the clearance to be formed.

4. A sliding system according to claim 1, in which the semi-spherical surface is formed with a recess at its top so that when the semi-spherical surface is fitted into the semi-spherical recess, a space acting as a reservoir of a lubricant oil is formed between the semi-spherical recess and the recess formed in the top of the semi-spherical surface.

5. A sliding system according to claim 1, in which the clearance has a size in a range from 5 to 500 $\mu$m .

6. A sliding system according to claim 1, in which the annular sliding contact region of the semi-spherical surface has its surface coated by a resin film containing at least one of $Mo^s{}_2$ and Gr.

7. A sliding system according to claim 1, in which the surface of the annular sliding contact region of the semi-spherical surface is subjected to a nitriding treatment before it is coated by a resin film containing at least one of $Mo^s{}_2$ and Gr.

8. A sliding system according to claim 1, in which the surface of the annular sliding contact region of the semi-spherical surface is coated with a hard film layer which is selected from an amorphous carbon film, Ni—P plating and Ni—B plating.

9. A sliding system according to claim 1, in which the first movable member comprises a piston of a swash plate compressor and the second movable member comprises a swash plate of the swash plate compressor.

10. The sliding system of claim 1, wherein a line parallel to the vertical axis and passing through the inner perimeter of the annular sliding contact region intersects the concave portion of the end face a distance C2 above the horizontal axis, the outer perimeter of the concave portion of the end face being provided at a distance C1 above the horizontal axis and $C2/C1 \leqq 0.3$.

11. A sliding system including a first movable member having a semi-spherical recess, a second movable member having a flat surface and a semi-spherical shoe having a semi-spherical surface which is fitted into the semi-spherical recess of the first movable member and an end face which is disposed in sliding contact with the flat surface of the second movable member, wherein a sliding contact region is formed on the semi-spherical surface in a region provided between the top of the shoe and the end face, the semi-spherical surface having a lead-in provided in a region located above the sliding contact region, the semi-spherical surface being arranged in the semi-spherical recess such that a clearance is formed between the lead-in and an opposing portion of the semi-spherical recess which gradually increases toward the top of the semi-spherical surface, a recess being formed in the top of the semi-spherical surface so that a space for serving as a reservoir for a lubricant is formed between the semi-spherical recess and the recess formed in the top of the semi-spherical surface and an opening being formed in the end face of the shoe so that a space for serving as a reservoir for a lubricant is formed between the flat surface of the second movable member and the opening formed in the end face of the shoe, wherein the recess formed in the top of the semi-spherical surface has a depth of about one-third the depth of the opening formed in the end face of the shoe.

* * * * *